United States Patent [19]

Vogt

[11] 4,199,669

[45] Apr. 22, 1980

[54] COIN-SENSING ASSEMBLY

[75] Inventor: Carl L. Vogt, St. Louis, Mo.

[73] Assignee: Coin Acceptors, Inc., St. Louis, Mo.

[21] Appl. No.: 879,148

[22] Filed: Feb. 21, 1978

[51] Int. Cl.[2] ..... H01H 35/00

[52] U.S. Cl. ..... 200/52 R; 133/2; 200/61.42; 200/153 T

[58] Field of Search ..... 200/52 R, 61.44, 61.41, 200/61.42, 61.43, 153 T, 330, 333; 193/1; 194/1 R, 1 A, 1 B, 1 C, 1 D, 1 E, 1 F, 1 G, 1 H, 1 J, 1 K, 1 L, 1 M, 1 N, 1 P; 133/1 R, 2, 4 R

[56] References Cited

U.S. PATENT DOCUMENTS

| | | | |
|---|---|---|---|
| 2,954,037 | 9/1960 | Williams et al. | 133/2 |
| 3,963,035 | 6/1976 | Levasseur | 133/2 |

*Primary Examiner*—Gene Z. Rubinson

*Assistant Examiner*—Morris Ginsburg

*Attorney, Agent, or Firm*—Cohn, Powell & Hind

[57] ABSTRACT

A coin-sensing assembly having a tube for holding a supply of coins, and a coin-sensing lever pivotally mounted on a bracket attached to the housing adjacent the tube, the lever including a coin-engaging portion extending into the tube for engagement with the coins held in the tube. A switch is mounted on the bracket and includes a resiliently actuated switch member engageable with the lever and resiliently urging the lever toward a first position upon disengagement of the coin-sensing portion with the coins in the tube for conditioning the switch for one operation. The lever is pivotally movable to a second position upon engagement of the coin-engaging portion with the coins in the tube for actuating the switch member and conditioning the switch for another operation.

10 Claims, 9 Drawing Figures

COIN-SENSING ASSEMBLY

BACKGROUND OF THE INVENTION

This invention relates generally to an improved coin-sensing assembly for reacting to a predetermined number of coins in a coin storage tube in a coin changer used in a vending machine.

In the heretofore conventional device, the switch actuator was a two-part assembly, one being a sheet metal part that contacted the switch button and the other being a wire form extension that came in contact with tube levers that protruded into the coin tube, the levers being pivoted about a rod mounted on the changer housing. The switch actuator assembly pivoted in the switch case to depress the switch button when activated by the coin-engaging lever. This device, as is apparent, required a multiplicity of parts that was difficult and time-consuming to assemble, and required intital adjustments and frequent service adjustments to maintain acceptable operation.

SUMMARY OF THE INVENTION

The present coin-sensing assembly has only a few operating parts and requires no adjustments either initially or in service to maintain operation.

The coin-sensing levers can be readily assembled to the switch bracket with the switches already in place. Because of the unique construction of the bracket and the levers, the resilient loading of the switch members or buttons is utilized to retain the levers until the subassembly is mounted into the changer housing. Once the mounting is complete, the levers are trapped between the housing and the bracket, yet are free to pivot.

The coin-sensing assembly includes a coin-sensing lever means pivotally mounted to a bracket and pivotally movable between a first position and a second position. An interconnecting means between the bracket and lever means precludes disconnection of the lever means and bracket in the first position of the lever means, and enables disconnection or connection selectively of the lever means and bracket in the second position of the lever means. A switch means mounted on the bracket, includes a resiliently actuated switch member engageable with the lever means and resiliently maintaining the lever means in the pivoted first position, the switch member being resiliently actuated by the lever means upon selective pivotal movement of the lever means to the second position for effecting connection or disconnection selectively of the lever means and bracket.

More particularly, the bracket includes a rearwardly open socket, and the lever means includes a pin pivotally mounted in the socket, and a cam engageable with the switch member. The interconnecting means between the bracket and lever means precludes disconnection of the pin from the socket in the first position and enables disconnection or connection selectively of the pin and socket in the second position.

The interconnecting means for each lever includes a passage communicating with the socket and an abutment on the bracket adjacent the passage. A neck portion on the lever is connected to the pin and is adapted to pass through the passage. A stop on the lever engages the bracket abutment in the first position of the lever for precluding disconnection of the pin and socket and precluding movement of the neck portion through the passage, and disengages from the bracket abutment in the second position of the lever for enabling disconnection or connection selectively of the pin and socket and enabling movement of the neck portion through the passage.

The coin-sensing assembly includes a tube means adjacent a housing means for holding a supply of coin. The bracket is mounted on the housing means. The coin-sensing lever is pivotally mounted on the bracket and includes a coin-engaging portion extending into the tube for engagement with the coins. The resiliently actuated switch member engages the lever and resiliently urges the lever toward the first position upon disengagement of the coin-engaging portion with the coins in the tube for conditioning the switch for one operation, the lever being pivoted to the second position upon engagement of the coin-engaging portion with the coins for actuating the switch member against its resilient loading and conditioning the switch for another operation.

The socket of the bracket is open between the bracket and housing, and the coin-sensing lever includes a pin pivotally mounted in the socket and trapped between the housing and bracket.

The coin-engaging portion of the lever extends into the tube at a predetermined height to disengage from a predetermined number of coins in the tube for enabling the switch member under resilient loading to pivot the lever from the second position to the first position, and the coin-engaging portion engages at least a predetermined number of coins in the tube for pivoting the lever from the first position to the second position against the resilient loading of the switch member.

DESCRIPTION OF THE PREFERRED EMBODIMENT

Figure 2:
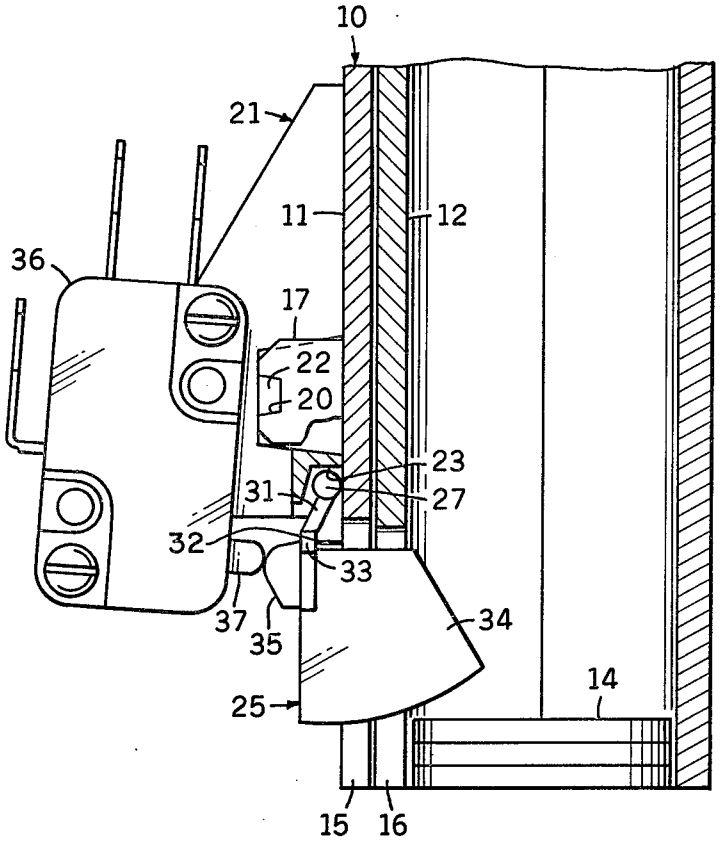
FIG. 2 is a longitudinal cross sectional view similar to FIG. 1, but illustrating the coin-sensing lever in its first position out of engagement with coins disposed in the tube.

The coin-sensing assembly includes a housing means indicated by 10 having a vertical housing wall 11. Mounted on the housing wall 11 are a pair of tubes 12 and 13, each of which is sized to accommodate and hold a stack of coins 14. It will be understood that tube 12 receives and holds one denomination of coins, while tube 13 receives and holds another denomination of coins. The coins 14 in these tubes 12 and 13 are used to make change in a vending machine operation.

At the lower end of the housing wall 11, there is provided a pair of vertically elongate slots 15 directly aligned with the longitudinal center axis of the tubes 12 and 13. Aligned with the housing wall slots 15 is a compatible and cooperating pair of elongate slots 16 formed in the tubes 12 and 13. The purpose of the slots 15 and 16 will be later described.

Formed intregally with and extending rearwardly from the housing wall 11, is a mounting arm 17, the arm 17 being provided with a horizontally disposed groove 20.

A bracket referred to by 21, is mounted on the housing wall 11. The bracket 21 includes a substantially horizontal locator pin 22 that is received in the groove 20 of mounting arm 17.

Formed in the bracket 21 is a pair of rearwardly open, pivot sockets 23 and 24, each of which is substantially horizontally elongate and define a pivot axis. These pivot sockets 23 and 24 are closed by the housing wall 11 when the bracket 21 is mounted.

Figure 1:
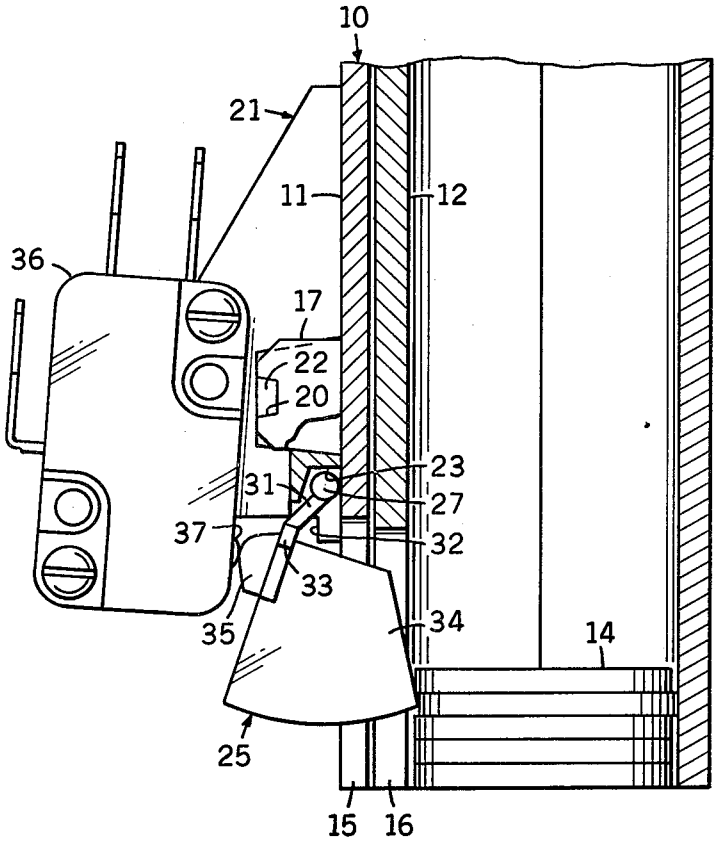
FIG. 1 is a longitudinal cross sectional view of the coin-sensing assembly illustrating the lever pivoted to its second position by engaging coins disposed in the tube.
Figure 4:
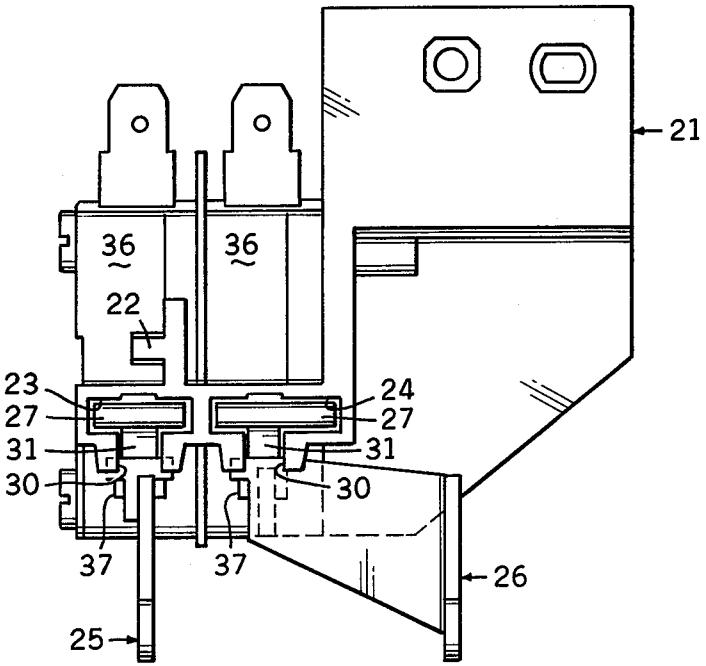
FIG. 4 is a front elevational view of the bracket-switch-lever sub-assembly unmounted from the housing.
Figure 3:
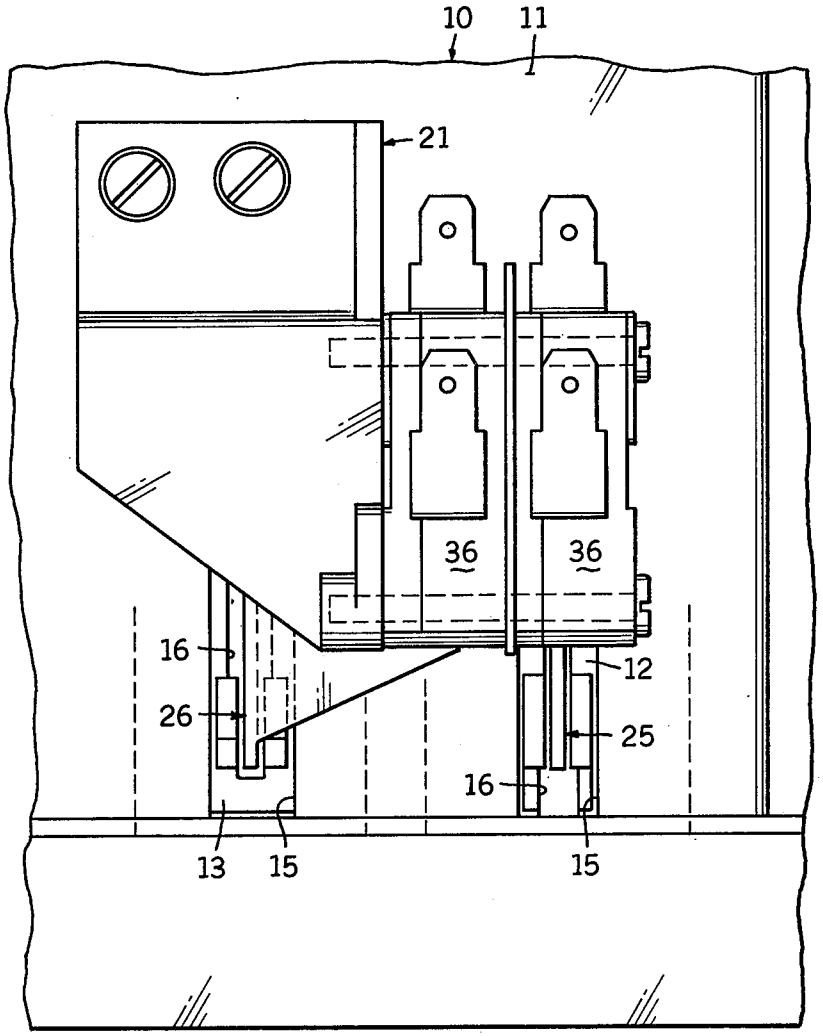
FIG. 3 is a fragmentary, side elevational view of the assembly as seen from the left of FIG. 1.
Figure 5:
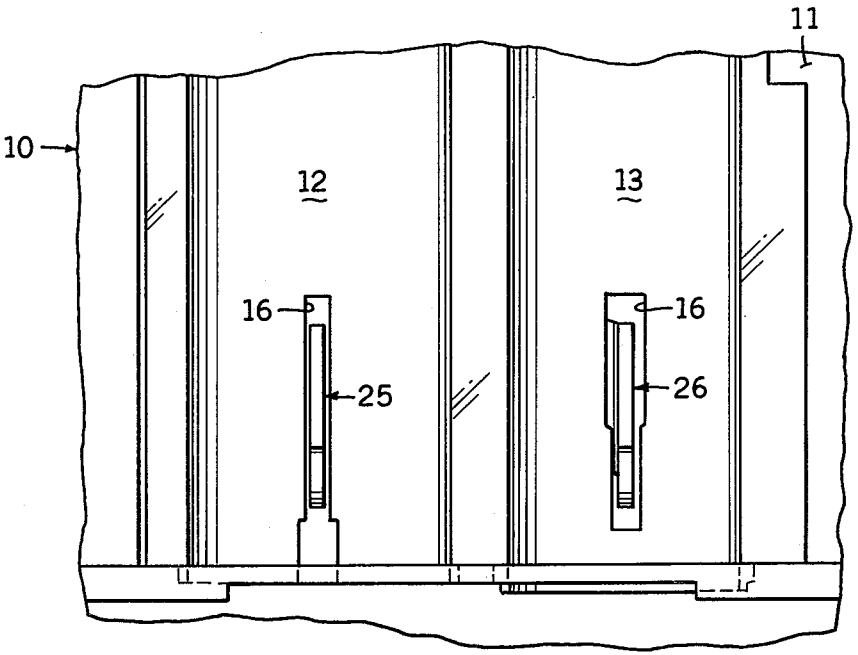
FIG. 5 is a fragmentary elevational view as seen from the right of FIG. 1.
Figure 6:
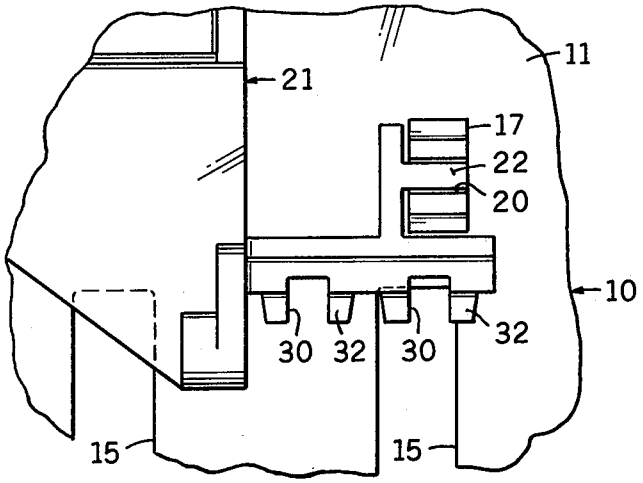
FIG. 6 is a fragmentary rear elevational view of the bracket shown in FIG. 3, but with the switches removed.
Figure 9:
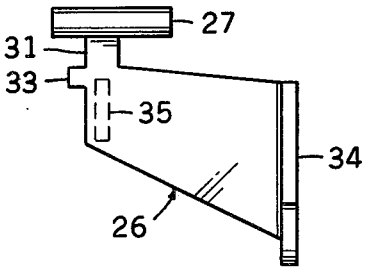
FIG. 9 is a front elevational view of the other lever.
Figure 8:
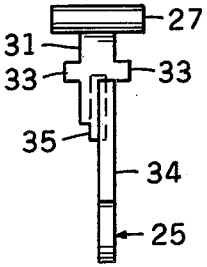
FIG. 8 is a front elevational view of the lever shown in FIG. 7.
Figure 7:
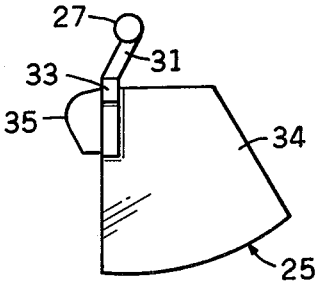
FIG. 7 is a side elevational view of one lever.

Pivotally mounted to the bracket 21 is a pair of coin-sensing levers indicated by 25 and 26 which are pivotally movable between a first position suggested in FIG. 2 and a second position suggested in FIG. 1. Each of the levers 25 and 26 includes an elongate, substantially horizontal pivot pin 27 pivotally mounted in its associated pivot socket 23 and 24 respectively.

Interconnecting means are provided between the bracket 21 and the levers 25 and 26 to preclude disconnection of the levers 25 and 26 and bracket 21 in the first position of the levers, and enable disconnection or connection selectively of the levers 25 and 26 and bracket 21 in the second position of the levers when the bracket is unmounted from the housing wall 11. The interconnecting means includes a passage 30 formed in the bracket 21 and communicating with the lower side of each pivot socket 23 and 24. A neck portion 31 of each lever 25 and 26, formed integrally with and depending from its associated pivot pin 27, is adapted to pass through its associated bracket passage 30. Provided on the bracket 21 adjacent each of the passages 30, is an abutment 32 adapted to engage laterally extending tabs 33, constituting stop means, on the levers 25 and 26. The tabs 33 on the levers 25 and 26 engage the bracket abutments 32 in the first position of the levers for precluding disconnection of the pivot pins 27 and their respective pin sockets 23 and 24 and preclude movement of the lever neck portions 31 through the bracket passages 30. The tabs 33 are disengaged from the bracket abutments 32 in the second position of the levers 25 and 26 for enabling disconnection or connection selectively of the pivot pins 27 and respective pin sockets 23 and 24 and enable movement of the lever neck portions 31 through the bracket passages 30.

Each of the levers 25 and 26 includes a coin-engaging portion 34 that extends into an associated coin tube 12 or 13 through a pair of aligned slots 15 and 16, the coin-engaging portion 34 engaging the coins 14 held in the associated tube. Further, each of the levers 25 and 26 includes a cam 35, the purpose of which will be later described.

Mounted on the bracket 21 is a pair of switches 36, constituting switch means, that activate or deactivate electrical circuits (not shown) depending upon the number of coins 14 retained in the coin tubes 12 and 13. For example, if sufficient coins 14 are retained in the tubes 12 and 13 to enable the discharge of sufficient change from such tubes, the switches 36 will activate the associated electrical circuits to permit the appropriate discharge of coins from the tubes. However, if the number of coins 14 in the tubes 12 and 13 are not sufficient to enable the discharge of appropriate change, the switches 36 will operate through the electrical circuits to prevent the operation of the vending mechanism unless exact change is used.

Each of the switches 36 includes a resiliently actuated switch member 37 engageable with the cam 35 of an associated lever 25 or 26, the switch member 37 urging the associated lever 25 or 26 under its resilient loading toward the first position illustrated in FIG. 2 upon disengagement of the coin-engaging portion 34 from coins 14 in the associated tube 12 or 13 for conditioning the switch 36 for one operation. The levers 25 and 26 are pivoted to the second position illustrated in FIG. 1 upon engagement of the coin-engaging portion 34 with the coins 14 in the associated tube 12 or 13 for actuating the switch member 37 against its resilient loading and conditioning the switch 36 for another operation.

The coin-engaging portion 34 of each lever 25 and 26 extends into the associated tube 12 or 13 at a predetermined height to disengage from a predetermined number of coins in the tube for enabling the associated switch member 37 under resilient loading to pivot the lever from the second position to the first position. The coin-engaging portion 34 of each lever 25 or 26 engages at least a predetermined number of coins 14 in the associated tube 12 or 13 for pivoting the lever from the first position to the second position against the resilient loading of the associated switch member 37.

In assembling the coin-sensing assembly, the switches 36 are attached to the bracket 21 before the bracket 21 is fixed to the housing wall 11. Then, each of the levers 25 and 26 is pivotally mounted on the bracket 21 to provide a sub-assembly. As each lever 25 and 26 is pivotally mounted, the lever is disposed in its second position, suggested in FIG. 1, in which the associated switch member 37 is depressed under its resilient loading by the lever cam 35. As the switch member 37 is resiliently depressed, the lever neck portion 31 is passed through the associated bracket passage 30 so that the lever tabs 33 are located behind the bracket abutments 32 and the pivot pin 27 is disposed in its associated pivot socket 23 or 24. When the lever 25 or 26 is connected in this manner, the resilient loading of the switch member 37 will engage the lever cam 35 and pivot the lever to its extended first position, suggested in FIG. 2, in which the lever tabs 33 engage the bracket abutments 32 and the pivot pin 27 is retained in its associated pin socket 23 or 24.

In this first position, the levers 25 and 26 cannot be unintentionally disconnected from the bracket 21 in the sub-assembly, even though the pivot sockets 23 and 24 are rearwardly open. To disconnect the levers 25 and 26, the levers must be moved from the extended first position to the retracted second position against the loading of the switch members 37 to permit removal of the lever neck portions 31 through associated bracket passages 30 and removal of the pivot pins 27 from associated pin sockets 23 or 24. Accordingly, it will be understood that the levers 25 and 26 are uniquely captivated by the bracket 21 and switches 36 in a sub-assembly prior to the mounting of the sub-assembly onto the housing wall 11.

Then, the locator pin 22 of bracket 21 is inserted into the groove 20 of locator arm 17, and the bracket 21 is secured to the housing wall 11. In this position, the levers 25 and 26 extend through the aligned pairs of elongate slots 15 and 16 and extend into the coin tubes 12 and 13 respectively.

When the bracket 21 is mounted to the housing wall 11, the pivot pins 27 of levers 25 and 26 are trapped in their associated pin sockets 23 and 24 between the bracket 21 and the housing wall 11, the housing wall 11 closing the rearwardly open pin sockets 23 and 24. The levers 25 and 26 are held in assembly and yet are free to pivot between the first and second positions described previously.

The operation of the coin-sensing levers 25 and 26 are identical so that a detailed explanation with respect to lever 25 will suffice for the other lever 26. Referring to FIG. 2, it will be understood that when the coin tube 12 is empty or has less than a predetermined number of coins 14 in the tube 12, the switch member 37 resiliently urges the lever 25 to its extended first position so that the switch 36 is conditioned for an operation that precludes actuation of the vending apparatus unless exact change is used. In FIG. 2, when less than the predetermined number of coins are disposed in the coin tube 12, the coin-engaging portion 34 of lever 25 extends fully into the coin tube 12 in a position over the coins 14.

When additional coins are disposed into the coin tube 12, so that there is the predetermined number or more, as is illustrated in FIG. 1, these coins engage the coin-engaging portion 34 of lever 25 and pivot the lever 25 to its second position against the resilient loading of switch member 37. In this second position of the lever 25, the associated switch 36 is conditioned for another operation to permit the vending apparatus to be used and deliver change if necessary from the coin tube 12.

I claim as my invention:

1. In a coin-sensing assembly:

(a) a bracket, (b) coin-sensing lever means pivotally mounted to the bracket and pivotally movable between a first position and a second position, (c) interconnecting means engaging the bracket and lever means for precluding disconnection of the lever means and bracket in the first position of the lever means and disengaging for enabling disconnection or connection selectively of the lever means and bracket in the second position of the lever means, and (d) switch means mounted on the bracket and including a resiliently actuated switch member engageable with the lever means and resiliently maintaining the lever means in the pivoted first position, the switch member being resiliently actuated by the lever means upon selective pivotal movement of the lever means to the second position for effecting connection or disconnection selectively of the lever means and bracket.

2. A coin-sensing assembly as defined in claim 1, in which:

(e) the bracket includes rearwardly open socket means, (f) the lever means includes:

(1) pin means pivotally mounted in the socket means, and (2) cam means engageable with the switch member, and (g) the interconnecting means precludes disconnection of the pin means from the socket means in the first position of the lever means ad enables connection or disconnection selectively of the pin means and socket means in the second position of the lever means.

3. A coin-sensing assembly as defined in claim 2, in which:

(h) the interconnecting means includes:

(1) a passage communicating with the socket means, (2) an abutment on the bracket adjacent the passage, (3) a neck portion of the lever means connected to the pin means and adapted to pass through the passage, and (4) stop means on the lever means engageable with the bracket abutment in the first position of the lever means for precluding disconnection of the pin means and socket means and precluding movement of the neck portion through the passage, the stop means being disengageable from the bracket abutment in the second position of the lever means for enabling disconnection or connection selectively of the pin means and socket means and enabling movement of the neck portion through the passage.

4. In a coin-sensing assembly:

(a) housing means, (b) tube means on the housing means for holding a supply of coins, (c) a bracket mounted on the housing means, (d) coin-sensing lever means pivotally mounted on the bracket, the lever means including a coin-engaging portion extending into the tube means for engagement with the coins held in the tube means, and (e) switch means mounted on the bracket and including a resiliently actuated switch member engageable with the lever means and resiliently urging the lever means pivotally toward a first position upon disengagement of the coin-engaging portion with the coins in the tube means for conditioning the switch means for one operation, the lever means being pivotally movable to a second position upon engagement of the coin-engaging portion with the coins in the tube means for actuating the switch member and conditioning the switch means for another operation.

5. A coin-sensing assembly as defined in claim 4, in which:

(f) the bracket includes a socket means open between the bracket and housing means, and (g) the coin-sensing lever means includes pin means pivotally mounted in the socket means and trapped between the housing means and the bracket.

6. A coin-sensing assembly as defined in claim 4, in which:

(f) the coin-engaging portion of the lever means extends into the tube means at a predetermined height to disengage from a predetermined number of coins in the tube means for enabling the switch members under resilient loading to pivot the lever means from the second position to the first position.

7. A coin-sensing assembly as defined in claim 6, in which:

(g) the coin-engaging portion of the lever means engages at least a predetermined number of coins in the tube means for pivoting the lever means from the first position to the second position against the resilient loading of the switch member.

8. A coin-sensing assembly as defined in claim 4, in which:

(f) interconnecting means engage the bracket and lever means for precluding disconnection of the lever means and bracket in the first position of the lever means and disengage for enabling disconnection or connection selectively of the lever means and bracket in the second position of the lever means when the bracket is unmounted from the housing means.

9. A coin-sensing assembly as defined in claim 5, in which:

(h) interconnecting means includes:

(1) a passage communicating with the socket means, (2) an abutment on the bracket adjacent the passage, (3) a neck portion on the lever means connected to the pin means and adapted to pass through the passage, and (4) stop means on the lever means engageable with the bracket abutment in the first position of the lever means for precluding disconnection of the pin means and socket means and precluding movement of the neck portion through the passage when the bracket is unmounted from the housing means, the stop means being disengageable from the bracket abutment in the second position of the lever means for enabling disconnection or connection selectively of the pin means and socket means and enabling movement of the neck portion through the passage when the bracket is unmounted from the housing means.

10. A coin-sensing assembly as defined in claim 4, in which:

(f) the bracket includes a socket means open between the bracket and housing means, (g) the coin-sensing lever means includes pin means pivotally mounted in the socket means and trapped between the housing means and the bracket, (h) the coin-engaging portion of the lever means extends into the tube means at a predetermined height to disengage from a predetermined number of coins in the tube means for enabling the switch member under resilient loading to pivot the lever means from the second position to the first position, and the coin-engaging portion of the lever means engaging at least a predetermined number of coins in the tube means for pivoting the lever means from the first position to the second position against the resilient loading of the switch member, and (i) interconnecting means includes:

(1) a passage communicating with the socket means, (2) an abutment on the bracket adjacent the passage, (3) a neck portion on the lever means connected to the pin means and adapted to pass through the passage, and (4) stop means on the lever engageable with the bracket abutment in the first position of the lever means for precluding disconnection of the pin means and socket means and precluding movement of the neck portion through the passage when the bracket is unmounted from the housing means, and disengageable from the bracket abutment in the second position of the lever means for enabling disconnection or connection selectively of the pin means and socket means and enabling movement of the neck portion through the passage when the bracket is unmounted from the housing means.

* * * * *